252-99 AU 157 EX
5/27/86 4,591,448

United States Patent [19]
Goedhart et al.
[11] Patent Number: 4,591,448
[45] Date of Patent: May 27, 1986

[54] DISHWASHING COMPOSITIONS

[75] Inventors: Machiel Goedhart, Rozenburg; Franciscus H. Gortemaker, Mijnsheerenland; Hermanus C. Kemper, Brielle; Hendrik S. Kielman, Maassluis, all of Netherlands

[73] Assignee: Lever Brothers Company, New York, N.Y.

[21] Appl. No.: 660,603

[22] Filed: Oct. 12, 1984

[30] Foreign Application Priority Data

Oct. 20, 1983 [GB] United Kingdom ..... 8328076

[51] Int. Cl.[4] ..... C11D 9/42
[52] U.S. Cl. ..... 252/99; 252/95; 252/140; 252/174.21; 252/174.25

[58] Field of Search ..... 252/99, 113, 120, 121, 252/128, 131, 140, 155, 173, 174.21, 174.25, DIG. 19, 95

[56] References Cited

U.S. PATENT DOCUMENTS

| | | | |
|---|---|---|---|
| 4,005,027 | 1/1977 | Hartmann | 252/95 |
| 4,116,851 | 9/1978 | Rupe et al. | 252/103 |
| 4,166,039 | 8/1979 | Wise | 252/133 |
| 4,397,755 | 8/1983 | Brierley et al. | 252/140 |

*Primary Examiner*—Paul Lieberman
*Assistant Examiner*—John F. McNally
*Attorney, Agent, or Firm*—Milton L. Honig; James J. Farrell

[57] ABSTRACT

The use of a layered clay in a non-enzymatic dish-washing composition with a reduced pH of 9–11 provides for a significant reduction of spot and film formation on the cleaned articles.

4 Claims, No Drawings

DISHWASHING COMPOSITIONS

The present invention relates to cleaning compositions for housewares such as pots, pans, dishes, cups, saucers, bottles, glassware, crockery, kitchen utensils and other hard-surface housewares. Hereinafter, for brevity's sake, the compositions of the invention will be referred to as "dishwashing compositions", it being understood that this terminology shall embrace the cleaning of the articles as indicated above as well.

It is well known in the dishwashing art that the visual appearance of the cleaned article is a critical factor for a dishwashing composition to be satisfactory to the consumer. Frequently, after cleaning of an article a film is formed thereon, which results in the article showing a dull surface when dry, or spots are formed on an article after drying, both phenomena causing the article to have an "unclean" visual appearance.

Many proposals have already been made to reduce this film- and spot-formation. As it is generally believed that this film- and spot-formation is caused by precipitation of insoluble salts, primarily calcium salts, from the wash liquor onto the surface of the articles, these prior proposals mainly involve inactivation of the insoluble salt-forming cations by means of suitable sequestering agents. However, this does not always lead to products with a reduced film- and spot-formation; thus we have found that many machine dishwashing compositions, despite the presence therein of sodium tripolyphosphate, which is known to be a calcium sequestrant, give rise to spot-formation on glass articles to an undesired extent.

Usually, the currently available commercial machine dishwashing compositions are highly alkaline (pH 11–13.5) and there is now a tendency to develop compositions which are less alkaline (pH 9–11) to make them less aggressive. However, such a reduction in alkalinity may increase undesired spot formation.

It is therefore an object of the present invention to provide a machine dishwashing composition with a reduced pH and a reduced tendency to form films and spots on the articles cleaned therewith. We have now surprisingly found that this and other objects of the present invention can be achieved by the inclusion of an effective low level of a layered clay in a machine dishwashing composition with a reduced pH of between 9 and 11. The present invention will now be discussed in further detail hereunder.

The layered clay minerals suitable for use in the present invention belong to the geological classes of the smectites, the kaolins, the illites, the chlorites, the attapulgites and the mixed layer clays. Typical examples of specific clays belonging to these classes are:

- smectites, e.g. montmorillonite, bentonite, pyrophyllite, hectorite, saponite, sauconite, nontronite, talc, beidellite, volchonskoite, vermiculite;
- kaolins, e.g. kaolinite, dickite, nacrite, antigorite, anauxite, halloysite, indellite, chrysotile;
- illites, e.g. bravaisite, muscovite, paragonite, phlogopite, biotite;
- chlorites, e.g. corrensite, penninite, donbassite, sudoite, pennine, clinochlore;
- attapulgites, e.g. sepiolite, polygorskyte;
- mixed layer clays, e.g. allevardite, vermiculite-biotite.

The layered clay minerals may be either naturally occurring or synthetic. Preferred clay minerals for use in the present invention are natural or synthetic hectorites, montmorillonites and bentonites, and of these the hectorites are especially preferred. Many of the above clays are commercially available, and typical examples of commercial hectorites are the Laponites ex Laporte Industries Ltd, England; Veegum Pro and Veegum F ex R. T. Vanderbilt, U.S.A.; the Barasyms, Macaloids and Propaloids ex Baroid Division, National Read Comp., U.S.A.

Particularly preferred commercial hectorites are Laponite S, Laponite XLS, Laponite RD and Laponite RDS, of which Laponite XLS is especially preferred. This is a synthetic hectorite having the following characteristics: analysis (dry basis) $SiO_2$ 59.8%, MgO 27.2%, $Na_2O$ 4.4%, $Li_2O$ 0.8%, structural $H_2O$ 7.8%, with the addition of tetrasodium pyrophosphate (6%); specific gravity 2.53; bulk density 1.0.

The effective, low level of the layered clay to be included according to the present invention in the machine dishwashing compositions ranges from 0.001–10% by weight, usually from 0.1 to 5% by weight.

The compositions of the invention furthermore contain one or more alkali salts commonly used in dishwashing compositions. Thus, they may contain organic and/or inorganic builder salts such as the alkali metal ortho-, pyro- and tripolyphosphates and hexametaphosphates, silicates, carbonates, borates, citrates, carboxymethyloxysuccinates, nitrilotriacetates and ethylenediaminetetraacetates, and other known organic and inorganic builder compounds.

Usually, the amount of alkali salts in the compositions varies from 10–90% by weight, generally from 30–70% by weight.

The compositions of the invention may also contain a detergent-active compound. If a detergent-active compound is included, it usually is in an amount of from 0.5–10%, usually 1–5%. Any well-known type of detergent-active compound may be used, such as soaps, synthetic anionic, nonionic, amphoteric detergent surfactant and mixtures thereof. Preferably, a nonionic detergent surfactant is used, especially a low-foaming one. Suitable examples of such nonionic detergent surfactants can easily be found in M. Schick "Nonionic Surfactants" (1967).

The compositions may furthermore contain other useful additives such as oxygen- and chlorine-type bleaching agents, e.g. peroxy salts or chlorinated cyanuric acid salts, bleaching agent activators, hydrotopes, fillers, perfumes, colouring agents, germicides, soil-suspending agents, aminopolyphosphonic acids and alkali metal or alkaline earth metal salts thereof, anticorrosion agents such as fatty acids, benztriazole, and so on.

If an oxygen-type bleaching agent is used, it is particularly preferred in the present invention to use a persalt together with a bleach activator, such as sodium perborate tetrahydrate or monohydrate together with tetraacetylethylenediamine. The presence of alkali metal or alkaline earth metal salts of aminopolyphosphonic acids such as the calcium salt of ethylenediaminetetraphosphonic acid is also preferred because of its stabilising effect on the percompounds.

The compositions of the invention are particularly useful for machine dishwashing operations. They can be formulated to any desired physical shape, such as powders, granules, tablets, blocks, liquids, etc.

The products of the present invention are formulated such that they provide a wash liquor with a pH of between 9 and 11, preferably between 10 and 10.5 (at a concentration of 0.3% in water).

The present invention will now be further illustrated by way of example.

EXAMPLE 1

The following products were prepared by dry mixing:

| | control A % by weight | |
|---|---|---|
| sodium tripolyphosphate | 40 | 40 |
| soda ash | 39 | 39 |
| sodium disilicate | 12 | 12 |
| low-foaming nonionic surfactant | 1 | 1 |
| potassium dichlorocyanurate | 2 | 2 |
| perfume, moisture, $Na_2SO_4$ | 6 | 1 |
| Laponite ® XLS | — | 5 |
| pH | 10.5 | 10.5 |

A standard set of tumblers, soiled with a standard evaluation soil, was cleaned in a commercial dishwashing machine, sold by Bosch AG, Germany, under the code Bosch E 700, using the normal 65° C. programme. The above products were dosed at a concentration of 3 g/l. The water hardness was 8°-9° German hardness, No rinse aid was used in the rinse step.

The tumblers, after having been washed and rinsed and when dry, were visually assessed as to the formation of spots according to the following scale:

1=no spots
2=1-5 spots
3=6-10 spots
4=11-20 spots
5=more than 20 spots.

The above procedure was repeated six times.

The following results were obtained:

| | spot formation |
|---|---|
| comparison product without Laponite XLS | 3.5 |
| product A with Laponite XLS | 1.6 |

EXAMPLE 2

The following products were prepared by dry mixing:

| | comparison B % by weight | |
|---|---|---|
| sodium tripolyphosphate | 35 | 35 |
| soda ash | 30 | 30 |
| sodium disilicate | 12 | 12 |
| low-foaming nonionic surfactant | 1 | 1 |
| potassium dichlorocyanurate | 2 | 2 |
| sodium sulphate | 19 | 14 |

-continued

| | comparison B % by weight | |
|---|---|---|
| perfume, moisture | 1 | 1 |
| Laponite ® XLS | — | 5 |
| pH (0.3% aqueous solution) | 10.5 | 10.5 |

The wash procedure of Example 1 was repeated, but using a commercial dishwashing machine sold by Miele AG, Germany, under the code Miele G 550. The normal 65° C. programme was used, and the same further conditions as in Example 1 were used.

The following results were obtained:

| | spot formation |
|---|---|
| comparison product without Laponite XLS | 4.8 |
| product B with Laponite XLS | 1.8 |

EXAMPLE 3

Repeating Example 2 with the following products

| | comparison C % by weight | |
|---|---|---|
| sodium tripolyphosphate | 40 | 40 |
| soda ash | 20 | 20 |
| sodium sulphate | 22 | 17 |
| citric acid 1 aq. | 15 | 15 |
| low-foaming nonionic surfactant | 1 | 1 |
| potassium dichlorocyanurate | 2 | 2 |
| Laponite ® XLS | — | 5 |

gave the following results:

| | spot formation |
|---|---|
| comparison product without Laponite XLS | 4.4 |
| product C with Laponite XLS | 1.4 |

We claim:

1. A powdered non-enzymatic mechanical dishwashing composition consisting essentially of:
   (a) 0.5-10% of an active detergent;
   (b) 10-90% of a builder salt;
   (c) 1-5% of a chlorine bleaching agent; and
   (d) from 0.5-40% of a layered clay selected from the group consisting of the smectites, kaolins, illites chlorites, attapulgites and mixed layer clays;

the composition having a pH of between 9 and 11 at 3 g/l in aqueous solution.

2. The composition of claim 1, comprising 1-5% of (a), 30-70% of (b) and 0.5-20% of (d).

3. The composition of claim 1, wherein the layered clay is selected from the group consisting of hectorites, montmorillonites and bentonites.

4. The composition of claim 3, wherein the layered clay is a synthetic hectorite.

* * * * *